United States Patent [19]

Hoeg

[11] 4,037,046

[45] July 19, 1977

[54] ULTRA-HIGH PRESSURE VESSEL ELECTRICAL PASS-THROUGH CONNECTOR

[76] Inventor: Joseph G. Hoeg, Box A2 Rte. 2, Leonardtown, Md. 20650

[21] Appl. No.: 689,428

[22] Filed: May 24, 1976

[51] Int. Cl.[2] ..... H01B 17/26

[52] U.S. Cl. ..... 174/18; 174/152 R

[58] Field of Search ..... 174/18, 70 S, 151, 152 R, 174/152 E

[56] References Cited

U.S. PATENT DOCUMENTS

| | | | |
|---|---|---|---|
| 2,838,596 | 6/1958 | Foord | 174/152 R |
| 3,491,198 | 1/1970 | Mangels | 174/152 R |
| 3,825,320 | 7/1974 | Redfern | 174/152 R X |

FOREIGN PATENT DOCUMENTS

| | | | |
|---|---|---|---|
| 1,403,026 | 5/1965 | France | 174/18 |
| 47-2710 | 1/1972 | Japan | 174/18 |

*Primary Examiner*—Laramie E. Askin

*Attorney, Agent, or Firm*—R. Sciascia; R. Beers; S. Sheinbein

[57] ABSTRACT

A tapered electrical pass-through connector for allowing conductors to go through a hole in a vessel wall from the high pressure side to the low pressure side and capable of withstanding up to 150,000 PSI from the high pressure side. The small diameter end of the tapered connector is inserted into the vessel hole and the conductors extend through holes in the connector. A bonding agent surrounds the conductors in the connector holes and the holes are tapered and dimensioned to a small diameter to prevent the bonding agent from being blown out of the holes under pressure.

8 Claims, 1 Drawing Figure

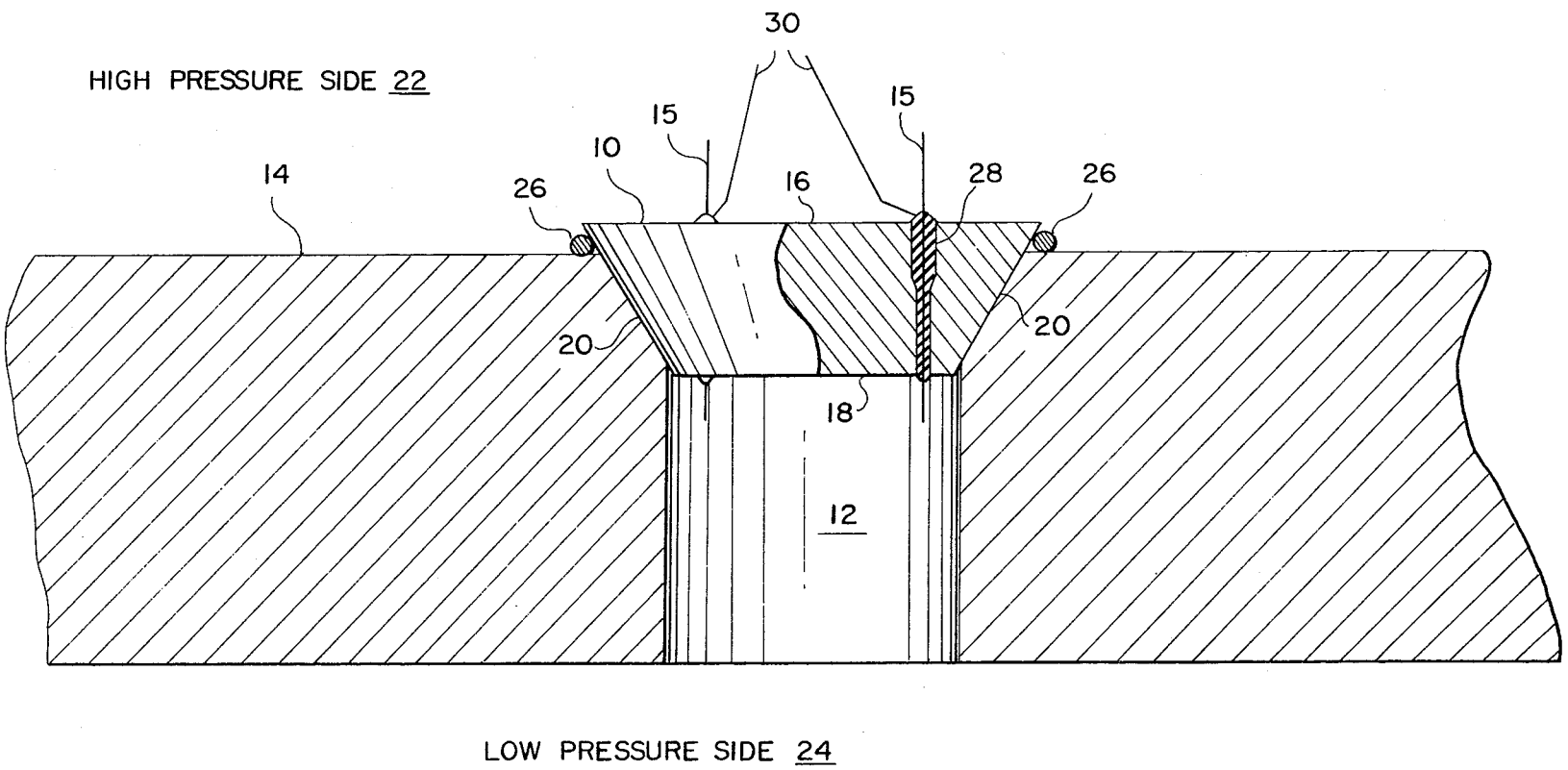
26
28
15
30
15
10
26
14
HIGH PRESSURE SIDE 22
20
16
18
12
20
LOW PRESSURE SIDE 24

ULTRA-HIGH PRESSURE VESSEL ELECTRICAL PASS-THROUGH CONNECTOR

STATEMENT OF GOVERNMENT INTEREST

The invention described herein may be manufactured and used by or for the Government of the United States of America for governmental purposes without the payment of any royalities thereon or therefor.

BACKGROUND OF THE INVENTION

This invention relates generally to electrical connectors, and more particularly to vessel pass-through electrical connectors for use under extremely high pressures.

The use of electrical pass-through connectors for a vessel wall, which connectors taper from a large diameter on the high pressure side to a small diameter on the low pressure side, is well-known in the connector art. An example of the state of the art is shown by U.S. Pat. No. 3,491,198 to T. F. Mangels wherein a hard material plug is filled with an insulating epoxy material through which the conductors pass. Although this type of connector has proven satisfactory in underwater hull usages where pressures rarely exceed 30,000 PSI, it has been found unable to withstand the higher pressures generated in some vessels since the epoxy material will be forced out due to the large size of the opening which is filled with epoxy. This large size requires the epoxy to withstand most of the pressure and thus limits the plug strength to that of the large epoxy mass.

SUMMARY OF THE INVENTION

Accordingly, there is provided a tapered electrical pass-through connector for use under extremely high vessel pressures wherein the connector holes through which the conductors pass are tapered to have a hole diameter 100 mils greater than the conductor at the high pressure large diameter end and 20 mils greater than the conductor at the low pressure small diameter end. The space in the hole is filled with a bonding agent and a length of at least 1 inch is provided between the large and small diameter ends of the tapered connector. The use of such a small hole diameter at the end of the tapered connector hole allows the connector to withstand pressures up to 150,000 PSI without the bonding agent being forced out. Either a conical taper or a stepped taper can provide the necessary decrease in hole diameter.

OBJECTS OF THE INVENTION

It is therefore an object of the present invention to provide an electrical pass-through connector capable of withstanding pressures up to 150,000 PSI.

It is a further object of the present invention to provide an electrical pass-through connector capable of withstanding repeated cycles of high pressure.

BRIEF DESCRIPTION OF THE DRAWING

These and other objects, features and attendant advantages of the present invention will become better understood by reference to the following detailed description when considered in connection with the accompanying drawing wherein:

The FIGURE shows the electrical pass-through connector inserted in a vessel wall in accordance with the present invention.

DETAILED DESCRIPTION OF THE DRAWING

Referring now to the FIGURE there is shown an electrical pass-through connector 10 inserted into a counter-bored vessel hole 12 in vessel wall 14 to allow passage of conductors 15 through the wall. Connector 10 has a truncated shape with large diameter end 16, small diameter end 18 and tapered side walls 20. Vessel wall 14 has high pressure and low pressure sides 22 and 24, respectively, and small diameter end 18 of connector 10 is inserted into vessel hole 12 from the high pressure side 22. Large diameter end 16 of connector 10 extends out of vessel hole 12 on the high pressure side 22 a sufficient distance to allow placing an O-ring 26, preferably made of rubber, around a portion of side wall 20 which also extends from the hole. The taper of side walls 20 is machined to be the reciprocal match of the taper of the counterbore of vessel hole 12 to allow for a reciprocal mating contact between the two surfaces. A conical taper is convenient due to ease of machining, but any taper could be used as long as a reciprocal match between side walls 20 and vessel hole 12 is provided.

One or more connector holes 28 are provided in connector 10 to allow for the passage of conductors 15 through the connector and, in turn, vessel wall 14. Only a single conductor 15 is passed through each connector hole 28 and the remainder of the hole is filled with an insulating bonding agent 30, for example, a two component epoxy strain gauge cement. Connector holes 28 have a decreasing diameter from large diameter end 16 to small diameter end 18 of connector 10 and this can be provided by either a tapered or a stepped hole shape. In order to avoid the epoxy being forced out under high pressures, connector 10 is dimensioned to be at least an inch in length between ends 16 to 18 and the diameter of connector holes 28 is selected to be approximately 100 mils greater than the conductor 15 diameter at large diameter end 16, and approximately 20 mils greater than the conductor diameter at small diameter end 18. It can be seen that the diameter of connector hole 28 at small diameter end 18 is quite small and provides only a minimum area around conductor 15 through which bonding agent 30 can pass. Inasmuch as a much greater amount of bonding agent exists in the other end of connector holes 28 (i.e. at the large diameter end 16) a maximum amount of pressure resistance is provided while still allowing good insulation of conductor 15.

In operation under pressure, the connector 10 will be forced against the counterbore of vessel hole 12 causing O-ring 26 to be compressed by the extending portion of side walls 20. In the meantime, bonding agent 30 is compressed tightly against conductors 15 by the tapered or stepped character of connector holes 28, and this allows for retaining conductor 15 in place at pressures of up to 150,000 PSI which is approximately 15 times the yield strength of a soft copper conductor. It should be noted that even at those high pressures, the rubber O-ring 26 remains in position since the contact between side walls 20 and the counterbore of vessel hole 12 tends to prevent its lateral extrusion from its location. When connector 10 is not under pressure, it can be held in place by any convenient manner, for example a screw with a backup yoke (not shown).

There has therefore been provided a convenient electrical pass-through connector for operating under pressures of up to 150,000 PSI and capable of repeated pressure cycling. The connector has been used successfully at pressures up to 150,000 PSI using 20 mil wire for conductor 15 and dimensioning connector holes 28 to be 120 mils at large diameter (and high pessure) end 16 and 40 mils at small diameter (and low pressure) end 18. Although these dimensions have worked well, satisfactory results can be generally obtained with other dimensions approximating a 3 to 1 taper of connector holes 28 as long as the diameter at the small end leaves only a small area around the conductor. The conductor may be made of any material strong enough to resist extrusion under such high pressures. Excellent results have been obtained with hardened maraging steel. Similarly any bonding agent capable of high pressure is satisfactory, Ciba Araldite being an example of a suitable epoxy compound. The term vessel is meant to include any structure with walls which are subject to large differential pressures. High pessures may be applied either from outside of the vessel such as in a ship hull or inside the vessel such as in a container filled with compressed gas.

Obviously, numerous modifications and variations of the present invention are possible in light of the above teachings. It is therefore to be understood that within the scope of the appended claims the invention may be practiced otherwise than as specifically described therein.

What is claimed and desired to be secured by Letters Patent of the United States is:

1. An electrical pass-through connector for passing conductors through a vessel hole extending from the high pressure side to the low pressure side of a vessel, said vessel hole having a tapered counterbore on said high pressure side, said connector being capable of developing a seal against pressures from said high pressure side of said vessel up to 150,000 PSI, comprising:

a small diameter end inserted into said vessel hole from said high pressure side whereby said small diameter end faces said low pressure side;

a large diameter end extending out of said vessel hole facing said high pressure side;

tapered side walls tapering between said large and small diameter ends, said taper reciprocally matching said tapered counterbore of said vessel hole whereby said connector will be in reciprocally mating contact with the walls of said tapered counterbore;

one or more connector holes extending through said connector from said large diameter end to said small diameter end with the diameter of said connector holes being greater at said large diameter end than at said small diameter end, each of said connector holes having a single conductor extending therethrough wherein said connector holes have a diameter which is approximately three times greater at said large diameter end than its diameter at said small diameter end, the remainder of each of said connector holes being filled with a bonding agent;

wherein said connector is at least an inch in length from said small diameter end to said large diameter end and wherein said connector holes have a diameter 100 mils. greater than said conductor at said large diameter end and 20 mils greater than said conductor at said small diameter end.

2. An electrical pass-through connector as set forth in claim 1 wherein said conductor diameter is 20 mils, and said connector holes have a diameter of 120 mils at said large diameter end and 40 mils at said small diameter end.

3. An electrical pass-through connector as set forth in claim 1 wherein said bonding agent is a two-component epoxy strain-gage cement.

4. An electrical pass-through connector as set forth in claim 1 wherein said connector is hardened maraging steel.

5. An electrical pass-through connector as set forth in claim 1 wherein said connector holes are conically tapered from said large diameter end to said small diameter end.

6. An electrical pass-through connector as set forth in claim 1 wherein said connector holes are stepped to allow the decrease in hole diameter from said large diameter end to said small diameter end.

7. An electrical pass-through connector as set forth in claim 1 wherein said tapered counterbore and sidewalls are conically tapered.

8. An electrical pass-through connector as set forth in claim 1 further comprising an O-ring placed on the high pressure vessel wall at the mouth of said vessel hole and held in place by a portion of said tapered side-walls extending from said vessel hole.

* * * * *